US010994328B2

(12) United States Patent
Håkonsen et al.

(10) Patent No.: US 10,994,328 B2
(45) Date of Patent: May 4, 2021

(54) METHOD FOR CASTING

(71) Applicant: NORSK HYDRO ASA, Oslo (NO)

(72) Inventors: Arild Håkonsen, Sunndalsøra (NO); Rune Ledal, Sunndalsøra (NO); Britt Elin Gihleengen, Ålvundeid (NO); Knut Omdal Tveito, Grøa (NO); John Erik Hafsås, Sunndalsøra (NO); Kjerstin Ellingsen, Oslo (NO); Qiang Du, Asker (NO); Mohammed M'Hamdi, Oslo (NO)

(73) Assignee: NORSK HYDRO ASA, Oslo (NO)

( * ) Notice: Subject to any disclaimer, the term of this patent is extended or adjusted under 35 U.S.C. 154(b) by 0 days.

(21) Appl. No.: 16/958,393

(22) PCT Filed: Jan. 21, 2019

(86) PCT No.: PCT/EP2019/051364

§ 371 (c)(1),
(2) Date: Jun. 26, 2020

(87) PCT Pub. No.: WO2019/166156

PCT Pub. Date: Sep. 6, 2019

(65) Prior Publication Data

US 2021/0053112 A1 Feb. 25, 2021

(30) Foreign Application Priority Data

Mar. 1, 2018 (NO) ..... 20180311

(51) Int. Cl.
*B22D 11/049* (2006.01)
*B22D 11/16* (2006.01)
(Continued)

(52) U.S. Cl.
CPC ..... *B22D 11/22* (2013.01); *B22D 11/003* (2013.01); *B22D 11/049* (2013.01); *B22D 11/16* (2013.01); *C22C 21/10* (2013.01)

(58) Field of Classification Search
CPC ..... B22D 11/003; B22D 11/049; B22D 11/16
See application file for complete search history.

(56) References Cited

U.S. PATENT DOCUMENTS 4,157,728 A 6/1979 Mitarriura et al.
2011/0297278 A1 12/2011 Xiong et al.
(Continued)

FOREIGN PATENT DOCUMENTS

EP 1 648 635 4/2006

OTHER PUBLICATIONS

International Search Report dated Apr. 16, 2019 in International (PCT) Patent Application No. PCT/EP2019/051364.
(Continued)

*Primary Examiner* — Kevin E Yoon
(74) *Attorney, Agent, or Firm* — Wenderoth, Lind & Ponack, L.L.P.

(57) ABSTRACT

A method for casting that includes a.) determining a diameter (D) of a cross section of a product to be cast in meter (m), b.) determining an intended steady-state casting speed (V) of the product to be cast using direct chill casting in meter per second (m/s), c.) determining a Si content (cSi) in percent by weight based on the total weight of a melt (wt-%) for the melt to be used for casting the cast product, d.) preparing a melt comprising Zn: 5.30 to 5.9 wt-%, Mg: 2.07 to 3.3 wt-%, Cu: 1.2 to 1.45 wt-%, Fe: 0 to 0.5 wt-%, Si: according to cSi, impurities up to 0.2 wt-% each and 0.5 wt-% in total, and balance aluminium, and e.) casting the melt into the cast product having the intended diameter (D) using direct chill casting, wherein the casting is carried out using the intended steady-state casting speed (V).

6 Claims, 6 Drawing Sheets

(51) Int. Cl.

| | |
|---|---|
| ***B22D 11/22*** | (2006.01) |
| ***C22C 21/10*** | (2006.01) |
| ***B22D 11/00*** | (2006.01) |

(56) References Cited

U.S. PATENT DOCUMENTS

| | | | | |
|---|---|---|---|---|
| 2012/0087826 | A1* | 4/2012 | Senkov | C22F 1/053 420/532 |
| 2012/0186773 | A1* | 7/2012 | Shaber | B22D 7/005 164/485 |
| 2015/0336165 | A1 | 11/2015 | Wagstaff et al. | |
| 2019/0062886 | A1* | 2/2019 | Leyvraz | C22F 1/053 |

OTHER PUBLICATIONS

Dons, Anne Lise, et al., "The Alstruc Microstructure Solidification Model for Industrial Aluminum Alloys", Metallurgical and Materials Transactions A, 1999, vol. 30A, pp. 2135-2146.

Mortensen, Dag, "A Mathematical Model of the Heat and Fluid Flows in Direct-Chill Casting of Aluminum Sheet Ingots and Billets", Metallurgical and Materials Transactions B, 1999, vol. 30B, pp. 119-127.

Thevik, Havard, et al., "A Mathematical Model for Surface Segregation in Aluminum Direct Chill Casting", Metallurgical and Materials Transactions B, 1999, vol. 30B, pp. 135-142.

Fjaer, Hallvard, et al., "ALSPEN—A Mathematical Model for Thermal Stresses in Direct Chill Castings of Aluminum Billets", Metallurgical Transactions B, 1990, vol. 21B, pp. 1049-1061.

M'Hamdi, Mohammed, et al., "TearSim: A Two-Phase Model Addressing Hot Tearing Formation during Aluminum Direct Chill Casting", Metallurgical and Materials Transactions A, 2006, vol. 37A, pp. 3069-3083.

Håkonsen, Arild, et al., "A new DC casting technology for extrusion billets with improved surface quality", Light Metals, 2014, pp. 873-878.

Lalpoor, M., et al., "Cold Cracking Development in AA7050 Direct Chill-Cast Billets under Various Casting Conditions", Metallurgical and Materials Transactions A, 2010, vol. 41A, pp. 2425-2434.

* cited by examiner a) b) c)

METHOD FOR CASTING

BACKGROUND

Alloys of the 7000 series ("AA7xxx") are frequently used for aerospace and transportation applications. However, AA7xxx alloys are difficult to cast as both hot and cold cracks can occur in a cast product. A hot crack is a crack that is generated in a cast product before the solidification of the melt is complete. A cold crack is a crack that forms in the cast product when the melt is completely solidified, and the cast product has reached a lower temperature or even room temperature. A crack is also known as a tear. Both types of cracks are undesirable in a cast product as they negatively influence the properties of the cast product. To avoid the formation of cracks when casting AA7xxx alloys, in particular AA7075, which is known to be difficult to cast, it has been found effective to use a, in comparison to the casting of other AA alloys such as 6xxx alloys, lower casting speed. However, this results in a lower efficiency of a casting system, as it takes more time to produce a cast product.

SHORT DESCRIPTION OF THE PRESENT INVENTION

The present invention provides a method for casting that allows more efficient casting of AA7xxx alloys. The inventors have found that the higher tendency of AA7xxx alloys to from hot and cold cracks during casting is due to their chemistry. That is, long solidification intervals, low-melting brittle intermetallic phases on grain boundaries and between dendrites combined with high thermal expansion coefficients of the phases constituting the microstructure of AA7xxx alloys make these alloys prone to both hot and cold cracking. The inventors found that hot cracks initiate during solidification of melt in the coherent mushy zone, when liquid feeding is restricted and deformation due to high residual thermal stresses exceeds the material strength. The inventors further found that cold cracks propagate during cooling of the solidified material when the material is in its brittle state. The inventors also found that hot cracks are potential initiation sites for cold-cracks.

Accordingly, to alleviate the afore-mentioned problems, the present invention provides a method for casting that allows efficient casting without cracks in a cast product. The method according to the invention comprises a.) determining a diameter (D) of a cross section of a product to be cast in meter (m), b.) determining an intended steady-state casting speed (V) of the product to be cast using direct chill casting in meter per second (m/s), c.) determining a Si content (cSi) in percent by weight based on the total weight of a melt (wt-%) for the melt to be used for casting the cast product, wherein the intended diameter (D), the intended steady-state casting speed (V) and the intended Si content (cSi) are determined such that the equations (I) $V*D \leq 0.00057-0.0017*cSi$ and (II) $V*D \geq 0.00047-0.0017*cSi$ and (III) $cSi \leq 0.1$ are fulfilled, d.) preparing a melt comprising Zn: 5.30 to 5.9 wt-%, Mg: 2.07 to 3.3 wt-%, Cu: 1.2 to 1.45 wt-%, Fe: 0 to 0.5 wt-%, Si: according to cSi, impurities up to 0.2 wt-% each and 0.5 wt-% in total, and balance aluminium, e.) casting the melt into the cast product having the intended diameter (D) using direct chill casting, wherein the casting is carried out using the intended steady-state casting speed (V). FIG. 6 shows a graphical representation of the process window defined by equations I to III. The diameter of the cross section of the product may optionally be between 0.45 m and 1 m. The silicon content of the melt may optionally be larger than 0.01 wt-%.

According to embodiments of the invention two out of the three variables V, D and cSi may be determined based on product or process requirements and the third variable may be determined using equations (I) to (III).

According to embodiments of the invention, the casting of the melt into the cast product may be carried out using between 14 and 20 cubic meter per hour and meter of intended diameter (m3/(h*D)) cooling water for the direct chill casting.

According to embodiments of the invention, in the preparing the melt, between 0.025 and 0.1 wt-% grain refiners based on Al, Ti and/or B may be added to the melt.

According to embodiments of the invention, the diameter (D) of the product to be cast may be the largest circle equivalent diameter in a (for example with respect to the vertical casting direction horizontal) cross section of the product to be cast. The largest circle equivalent diameter may be the diameter of the largest circle that fits into the profile (cross section) of a cast product while only covering material.

According to embodiments of the invention, the diameter (D) of the product to be cast may be larger than 450 mm. Optionally, a wiper may be used to remove water from the cast product. The wiper may be arranged neighboring a sump or bottom, that is on the vertical height of the lower end of the solidification zone during steady-state casting. The wiper may prevent that cooling water from the direct chill mold runs down along the surface of the cast product by providing a physical barrier for the water. The wiper may be designed such that cooling water cannot pass between the wiper and the cast product, e.g. by providing no or a narrow gap between the wiper and the cast product, so that water flowing along the surface of the casted product is diverted away from the surface of the cast product. The removal of cooling water may reduce the cooling rate of the cast product and may also result in an increase of the surface temperature of the cast product by heat transmission from the center of the cast product towards the surface, which may lower cracking tendencies. Accordingly, the temperature of the casted product can be precisely controlled by using a wiper to further mitigate hot and cold cracking tendency.

Herein, SI units or derived SI units are used. Temperatures are given in degree Celsius. Compositions are generally given in percent by weight based on the total weight, wherein the balance is aluminium. When describing the numerical simulations, some phases are described using atomic percent (at %) for a more convenient description of the stoichiometry.

SHORT DESCRIPTION OF THE FIGURES

DETAILED DESCRIPTION OF THE INVENTION

Figure 1:
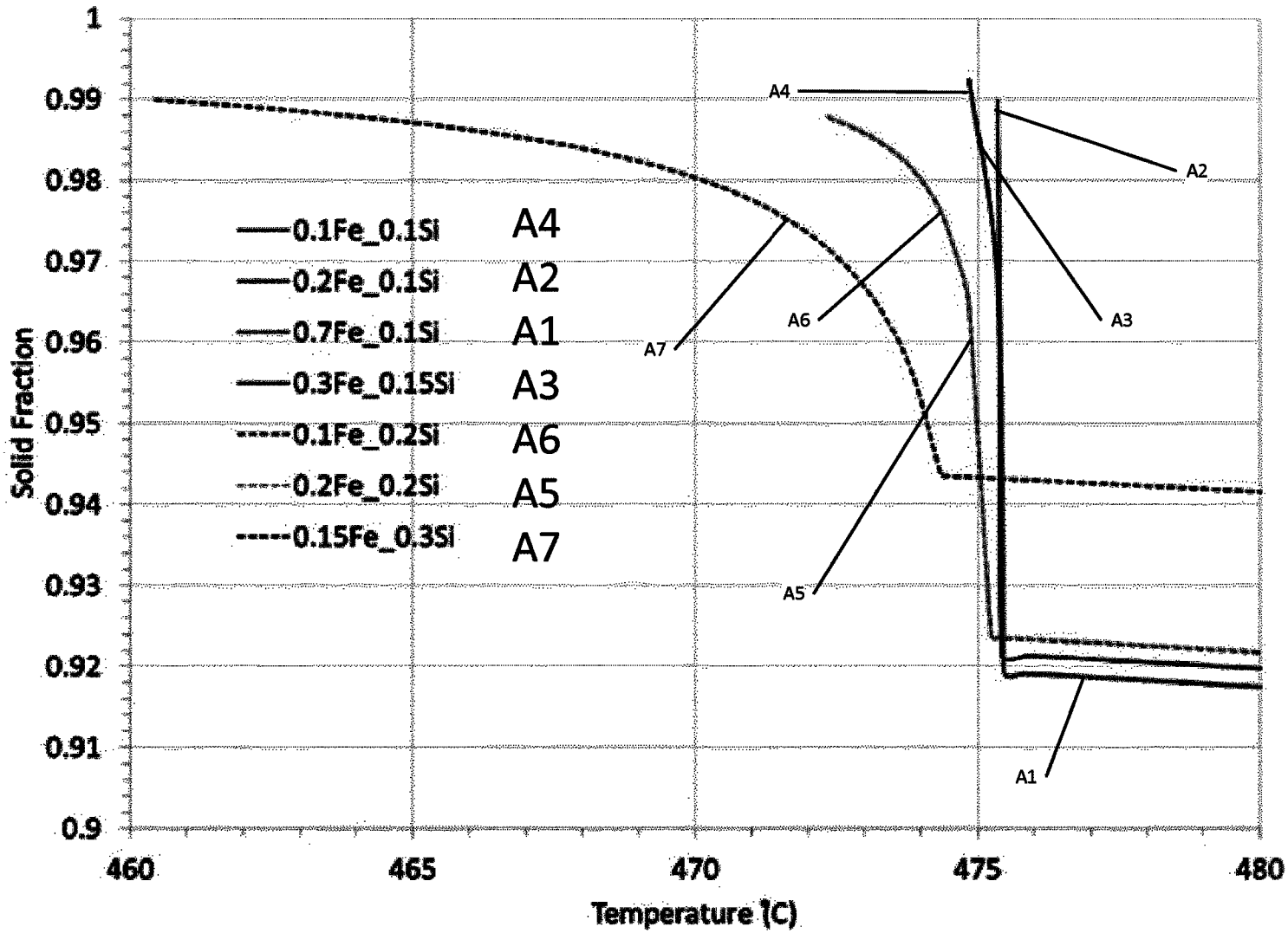
FIG. 1 shows calculated evolutions of solid fractions for alloys according to the invention and according to a comparative example with different Fe and Si contents.

Numerical simulations as well as industrial trials were carried out. The computer simulations involve microstructure simulations as well as casting process simulations. The industrial trials involve casting of billets (generally cylindrical cast products) having a diameter of 405 mm with varying chemical compositions. The billets were cast using a casting system as described e.g. in European Patent Specification EP1648635B1, which is incorporated herein by reference, or in A. Hakonsen, J. E. Hafsas, R. Ledal, Light Metals, TMS, San Diego, Calif., USA, 2014, 873-878.

Numerical Simulations

The numerical simulations involved the development of models that were then, in combination with appropriate data as described below, used for simulations to confirm the effectiveness of the embodiments of the present invention.

Microstructure Model

The Scheil model coded in the software Thermo-Calc (Version S by Thermo-Calc Software AB, Solna, Sweden) together with the TTAL7 database (developed by Thermotech Ltd., available via Thermo-Calc Software AB) has been used to calculate the solidification paths. The Scheil model is not able to predict how the cooling rate influences the microstructure formation. It is built on the assumptions that no diffusion occurs in the solid and that there is complete mixing in the liquid during solidification. Therefore, only the effect of alloy chemistry on the solidification path evolution is considered, while this model ignores kinetic factors such as diffusion.

Process Model

The Alsim model (e.g. described in D. Mortensen: Metallurgical and Materials Transactions B, 1999, 30B, 119-133. H. G. Fær and A. Mo: Metallurgical Transactions B, 1990, 21B, 1049-1061 and H. J. Thevik, A. Mo and T. Rusten: Metallurgical and Materials Transactions B, 1999, 30B, 135-142) is a finite element model for transient simulations of heat, fluid flow, macrosegregation, stresses and deformation for continuous casting processes. For direct chill (DC) casting, boundary conditions are described with a very high level of details regarding contact zones, air gap sizes, and water hitting points. The effects of stresses and displacements on contact zones, i.e. air gap formation between ingot and mould or bottom block, are accounted for in the thermal boundary conditions. Transient temperature and fraction of solid fields are input to a two-phase mechanical model presented in detail in the article: H. J. Thevik, A. Mo and T. Rusten: Metallurgical and Materials Transactions B, 1999, 30B, 135-142. The mechanical analysis is carried out both in the fully solid regions of the ingot as well as in the coherent part of the mushy zone. The upper boundary of the coherent mushy zone corresponds to the solid volume fraction at coherency that is input to the model. The hot cracking susceptibility is estimated by the integrated critical strain (ICS) as further described e.g. in M. M'Hamdi, A. Mo, H. G. Fjær, Metallurgical and Materials Transactions A, 2006, 37, 3069. The criterion is taking into account both the lack of melt feeding during solidification and thermal deformation, as these two phenomena are the main driving forces for hot tearing during DC casting:

$$\Delta\varepsilon(w_v, w_d) = \begin{cases} 0 & \\ t(g_s = g_s^{nof}) & \\ \int_{t(p_1 < p_c)} \left(w_v \cdot tr(\dot{\varepsilon}_s^p) + w_d \cdot \bar{\dot{\varepsilon}}_s^p\right) dt & \begin{matrix} for\ p_1 < p_c \\ for\ p_1 < p_c \end{matrix} \end{cases} \quad (1)$$

This hot cracking indicator ensures that no hot cracking occurs without insufficient feeding. This is taken care of by introducing a critical liquid pressure drop, pc. Above this value it is assumed that liquid feeding will prevent the formation of hot cracks even in the presence of a tensile stress state. When the pressure drop is lower than the critical value, volumetric and deviatoric viscoplastic (weighted by the functions wv and wd) straining of the material are assumed to contribute to the widening of existing pores and their growth into hot cracks. The parameter "gsnof" denotes the solid fraction at which coalescence and bridging between the grains in the microstructure of the cast product are fairly advanced and the alloy has obtained sufficient ductility to prevent the formation of a hot crack.

For cold cracking, the cracking susceptibility is estimated using a critical crack size (CCS) criterion as described in detail e.g. in the article: M. Lalpoor, D. G. Eskin, L. Katgerman, Metallurgical and Materials Transactions A, 2010, 41, 2425. The principle idea of the criterion is that if the defect size (i.e. a hot crack) exceeds the CCS at temperatures when the material is brittle, cold cracking will occur. The criterion accounts for the geometry of the initial defect (e.g. penny-shaped or thumbnail-shaped) as well as the temperature dependent plane strain fracture toughness (Klc). For example, for a penny-shaped (volumetric) crack the criterion is given by:

$$a_c = \frac{\pi}{4}\left(\frac{K_{Ic}}{\sigma_{11}}\right)^2 \quad (2)$$

where σ11 is the first principal stress σ11.

Microstructure Simulations

A series of simulations have been carried out for the alloys listed in Table 1 to simulate how variations in alloying content influence the solidification path and the phase formation towards the end of solidification. The alloying components, Zn, Mg, and Cu are kept fixed while the alloying components Fe and Si are added with different ratios.

FIG. 1 shows the last part of solidification for the alloys with varying Fe and Si content. That is, FIG. 1 shows the calculated evolutions of solid fraction for the model alloys A1 to A7 as shown in Table 1 with different Fe and Si contents.

It is apparent that the alloys with the highest Si content has a wider solidification interval by 15° C. The reaction which terminates the solidification for the alloys with low Si is $$\text{Liquid} \rightarrow \text{Mg2Si} + \text{MgZn2} \quad (3)$$

where the MgZn2 phase also contains Cu, i.e. the phase composition is 33 at % Mg, 30 at % Cu, 16 at % Zn and 11 at % Al. Increasing the Si content leads to a longer solidification interval as Si reacts with Mg to form Mg2Si. Less Mg will then be available for formation of the MgZn2-phase. If the amount of MgZn2 phase is insufficient to tie up all the Cu in liquid solution, low melting Cu containing phases, e.g. Al2CuMg_S and Al7Cu2M will form resulting in a wider solidification range. The iron bearing phases, are early forming phases and the variations in Fe are found to have no influence on the end of solidification and the solidification interval length.

TABLE 1

Composition of model alloys in wt-% with balance aluminium

| Alloy | Zn | Mg | Cu | Fe | Si |
|---|---|---|---|---|---|
| A1 (comparative) | 5.85 | 2.3 | 1.4 | 0.7 | 0.1 |
| A2 | | | | 0.2 | 0.1 |
| A3 | | | | 0.3 | 0.15 |
| A4 | | | | 0.1 | 0.1 |
| A5 | | | | 0.2 | 0.2 |
| A6 | | | | 0.1 | 0.2 |
| A7 | | | | 0.15 | 0.3 |

Process Simulations

Figure 2:
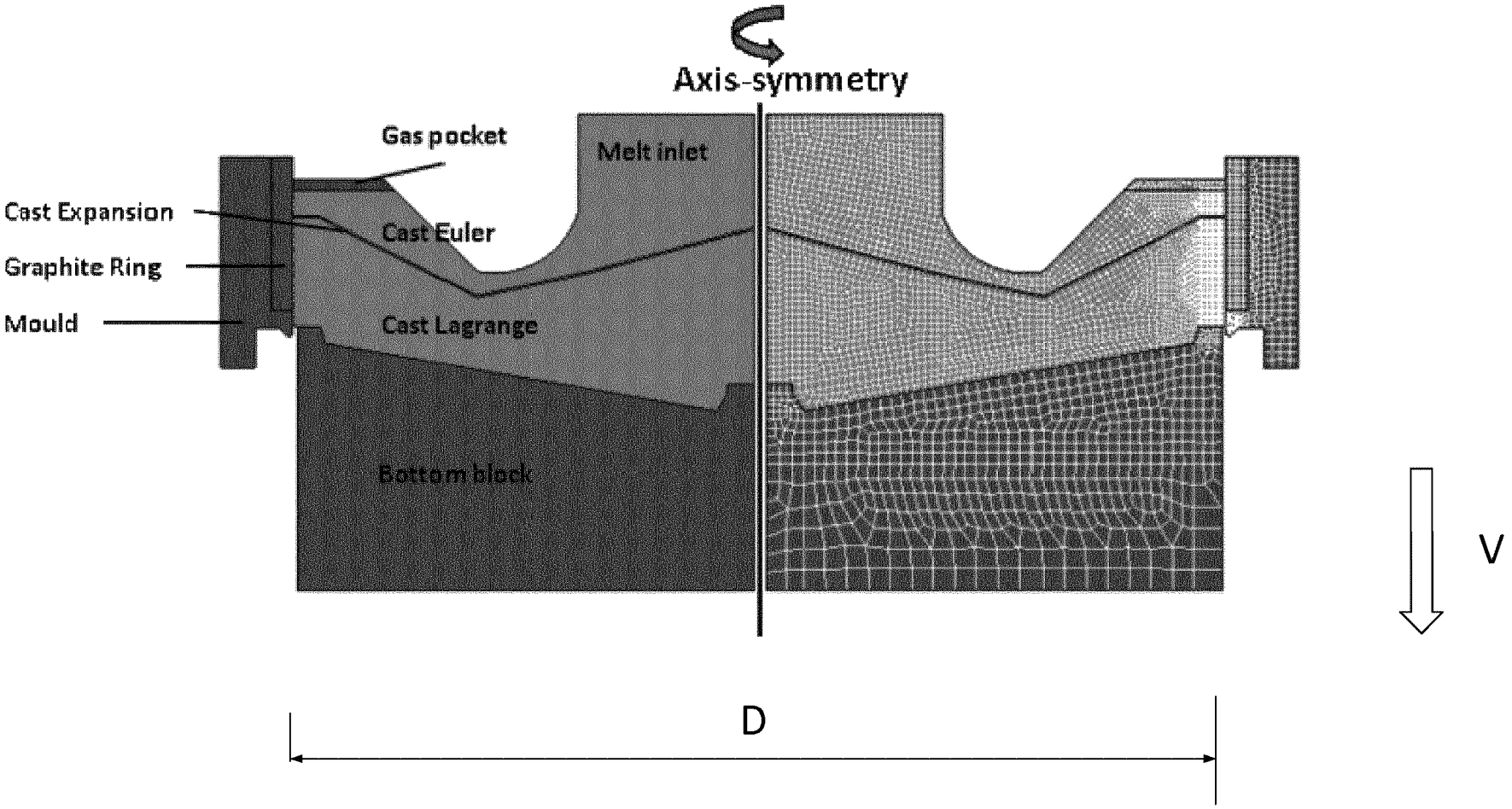
FIG. 2 shows a direct chill casting mold schematically in a horizontal cross section.

Cracking tendencies of the model alloys A2, A3, A6 and A7 have been compared by process modelling. Fully coupled heat transfer, flow and mechanical simulations were performed for casting of billets of the model alloys with diameter 405 mm using the LPC casting technology as described e.g. in EP1648635B1. The 2D axis-symmetric start up geometry and mesh is shown in FIG. 2. The solidification paths from ThermoCalc and thermophysical properties, e.g. densities, thermal conductivity, heat capacity and heat of fusion as function of temperature, calculated using the Alstruc software (see e.g. A. L. Dons. E. K. Jensen. Y. Langsrud. E. Tromborg and S. Brusethaug: Metallurgical and Materials Transactions A. 1999. 30A. 2135-2146) were used as input to the thermal model. For the constitutive mechanical equations, mushy zone parameters were extracted from the experimental 7050 data published in T. Subroto, A. Miroux, D. G. Eskin, K. Ellingsen, A. Marson, M. M'Hamdi and L. Katgerman, Proc. 13th International Conference on Fracture, Beijing, China, 2013, 9. For the fully solidified solid, the 7050 data published in M. Lalpoor, D. G. Eskin, and L. Katgerman, Materials Science and Engineering A, 2010, 527; 1828-1834 was used. The mechanical data used as input to the model are the same for all alloys and only the effect of the alloy chemistry on the solidification path and thermophysical properties are taken into account.

Transient simulations were performed until a casting length of 1 meter was reached. For all experiments, the casting speed was ramped up from 30 to 36 mm/min (millimeter per minute) after a short holding period of 30 s seconds and then kept constant (steady-state casting speed). The water amount was set to 7 m3/h (cubic meter per hour).

FIG. 2 shows the 2D start geometry and mesh. During casting, the melt is led into the mold via a melt inlet. In the mold, the melt is cooled using cooling water. The bottom or starter block is moved vertically downwards while melt flows continuously into the mold to produce the cast product. The speed, with which the bottom block is moved vertically downwards, is referred to as the casting speed. A casting speed that is too high will result in a cast product having cracks. A casting speed that is too low will result in a poor utilization of the casting equipment and a low production amount over time.

Figure 3:
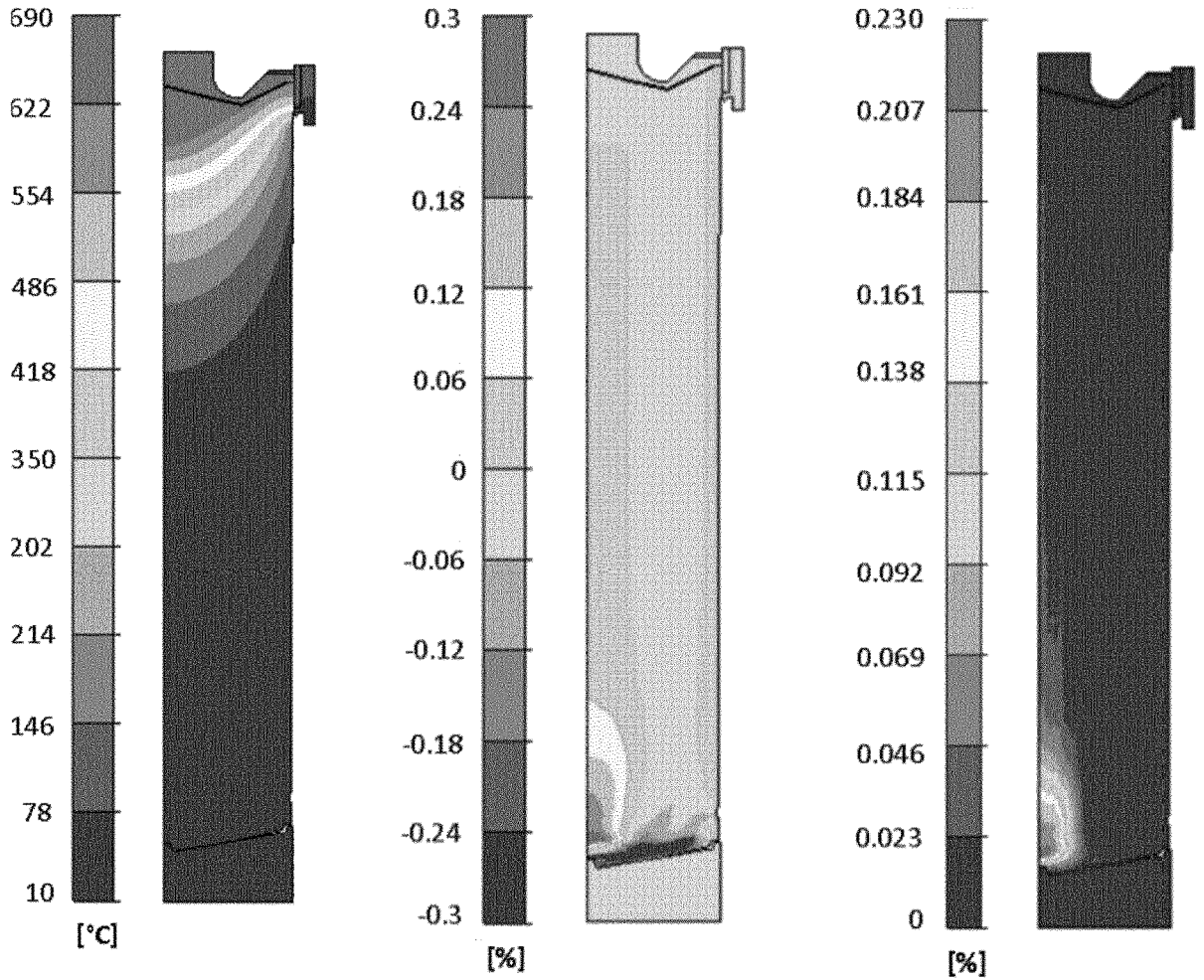
FIG. 3 shows temperature field in view (a), accumulated volumetric strain in view (b) and integrated critical strain in view (c) for alloy A2 at a casting length of approx. 1 m.

FIG. 3 shows the temperature field, the accumulated volumetric strain as well as the integrated critical strain (ICS) after a casting length of 1 m for alloy A2. View (a) of FIG. 3 shows the temperature field, view (b) shows the accumulated volumetric strain and view (C) shows the integrated critical strain. As is apparent e.g. from FIG. 3, the highest ICS values are found in the billet centre and the start-up period was found to be the most relevant phase for formation of centre cracks.

Figure 4:
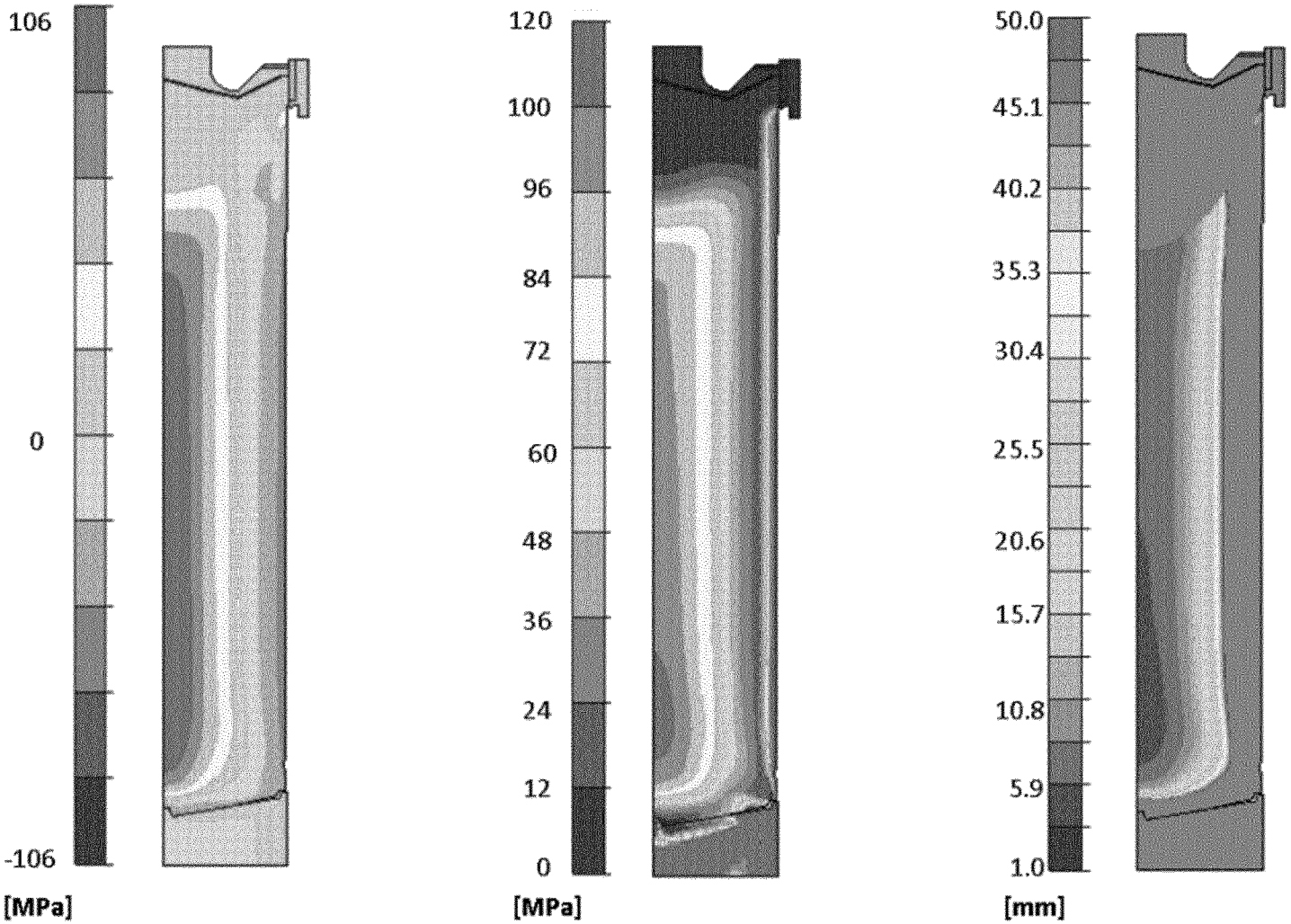
FIG. 4 shows mean stress in view (a), peak principal stress in view (b) and critical cracking size in view (c) for alloy A2 at a casting length of approx. 1 m.

The critical crack size criterion is shown together with the peak principal stress and the mean stress for alloy A2 in FIG. 4. The mean stress field shown in view (a) of FIG. 4 reveals compressive stresses at the surface and tensile stresses in the centre. The highest stress values in any direction as seen by the peak principal stress field (120 MPa) shown in view (b) of FIG. 4 are found in the center in the lower part of the casting. The areas with the smallest critical crack size are found in the same areas and the model indicates that defects in the order of 5 mm would propagate as cold cracks. The areas with the highest hot cracking sensitivity is coinciding with the areas with the smallest critical crack size and could be potential initiation points for cold cracking as is e.g. apparent from view (c) of FIG. 4.

Figure 5:
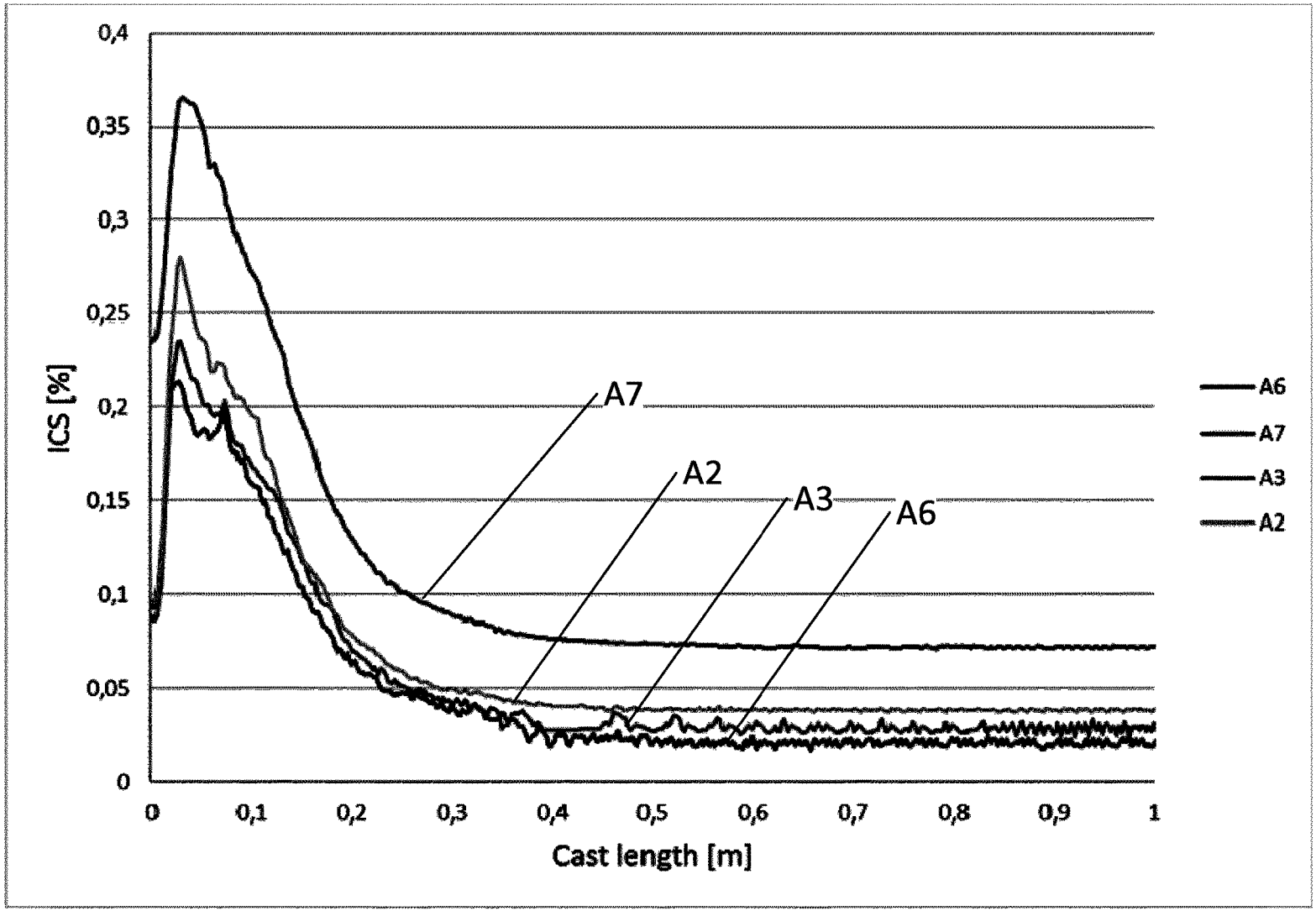
FIG. 5 shows the integrated critical strain from bottom to top through the center of a cast product, here a cylindrical billet, for alloys A2, A3, A6 and A7.

FIG. 5 shows values for the integrated critical strain through the billet center for all four alloys A2, A3, A6 and A7. The ranking of the hot cracking tendency follows the solidification interval length. The liquid pressure drop is found to be significantly higher indicating a more difficult liquid feeding of the mushy zone for the longer solidification intervals leading to a higher ICS value. As an increase in the Si content leads to longer solidification intervals, the hot cracking tendency correlates with the Si content.

Physical Experiments

A series of billets with varying chemical compositions as given in Table 2 were produced using direct chill casting as described in EP1648635B1, which is incorporated herein by this reference. Generally speaking and with reference to FIG. 2, a direct chill casting mold has openings on the top and the bottom. The melt is introduced into the mold via the top opening, at least partially solidifies in the mold to form the cast product. To facilitate solidification, water cooling may be used. Water may be led through water jackets in the mold and is sprayed on the at least partially solidified cast product exiting the mold. The total amount of water used during casting influences the cooling rate of the cast product. The cast product exits the mold via the bottom opening while it is supported on the downwards moving bottom block. The speed with which the cast product exists the mold is referred to as the casting speed or vertical casting speed. Herein, the casting speed refers to the steady state phase after the starting phase of a casting operation. The casting speed mentioned in the patent claims may be the maximum casting speed during the total casting operation (from startup phase to end of casting) according to the invention.

TABLE 2

Composition of experimental alloys in wt-%, balance aluminium, and casting speed in mm/min at which cracking occurs.

| Cast # | Fe | Si | Mg | Zn | Cu | $V_{critical}$ |
|---|---|---|---|---|---|---|
| 1 | 0.19 | 0.06 | 2.68 | 5.54 | 1.34 | 67.5 |
| 2 | 0.25 | 0.12 | 2.62 | 5.34 | 1.25 | 59 |
| 3 | 0.22 | 0.14 | 2.47 | 5.49 | 1.36 | 57.6 |
| 4 | 0.47 | 0.14 | 2.31 | 5.4 | 1.43 | 57 |
| 5 | 0.27 | 0.14 | 2.49 | 5.53 | 1.4 | 41.5 |
| 6 | 0.28 | 0.14 | 2.39 | 5.48 | 1.42 | 36 |
| 7 | 0.28 | 0.14 | 2.39 | 5.48 | 1.42 | 49 |
| 8 | 0.4 | 0.2 | 2.07 | 5.47 | 1.37 | 36 |
| 9 | 0.23 | 0.21 | 2.5 | 5.72 | 1.5 | 36 |
| 10 | 0.23 | 0.21 | 2.5 | 5.72 | 1.5 | 35 |
| 11 | 0.1 | 0.23 | 2.76 | 5.68 | 1.47 | 35 |
| 12 | 0.1 | 0.23 | 2.76 | 5.68 | 1.47 | 36 |

TABLE 2-continued

Composition of experimental alloys in wt-%, balance aluminium, and casting speed in mm/min at which cracking occurs.

| Cast # | Fe | Si | Mg | Zn | Cu | $V_{critical}$ |
|---|---|---|---|---|---|---|
| 13 | 0.11 | 0.24 | 3.29 | 5.47 | 1.42 | 39 |
| 14 | 0.11 | 0.25 | 2.68 | 5.61 | 1.39 | 48 |
| 15 | 0.1 | 0.25 | 3.05 | 5.67 | 1.45 | 36 |
| 16 | 0.41 | 0.4 | 2.1 | 5.66 | 1.47 | 33.9 |

Figure 6:
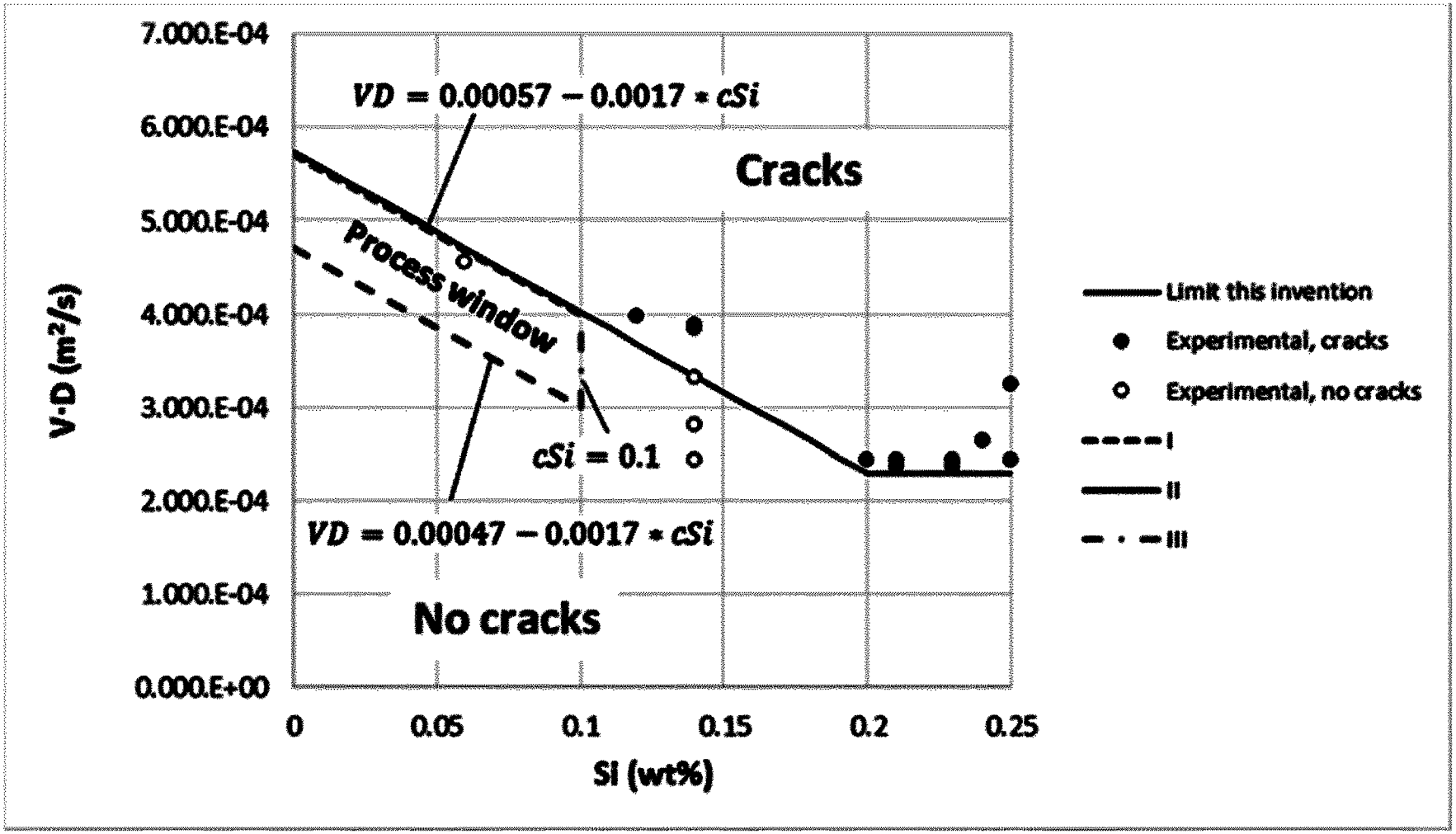
FIG. 6 shows the process window for casting depending on Si content (cSi), casting speed and diameter of the cast product according to embodiments of the present invention.

Six billets were cast in parallel for the present experiments. The cooling conditions were kept similar for all castings. After reaching the steady state, the casting speed was slowly ramped up until cold cracking in two billets occurred. The casting speed when two billets had a cold crack is denoted "critical casting speed" ($V_{Critical}$) and is given in millimeter per minute. The cold cracking was observed through the audible sound when the cold crack was forming. It was found that the alloys with higher Si content cracked at lower casting speeds, whereas the alloys with a low Si content cracked at higher casting speeds or did not crack. The correlation between the Si content and the critical casting speed is shown in FIG. 6. The observed behavior is explained by longer solidification intervals due to formation of low-melting phases resulting in increasing cracking tendency in the billet center as is also confirmed by the numerical simulations. It is also confirmed by the numerical simulations together with the mechanism of heat transfer, that the diameter of the cast product has an influence on the critical casting speed. It is further found from heat transfer considerations that the diameter of a cast product can be approximated as the largest circle equivalent diameter of a cast product in a—with respect to the vertical casting direction—horizontal cross section of the cast product.

The inventors found that the critical casting speed is generally independent of the content of Mg, Cu, Fe, and Zn of the melt. The inventors also found that the critical casting speed and the Fe/Si-ratio are independent from each other. However, to improve casting efficiency and product properties, the alloy used in the method according to the present invention may optionally comprise a minimum of 0.01 wt-% Si.

Accordingly, to achieve efficient casting and to produce an efficient cast product, the contents of Mg, Cu, Fe and Zn may be chosen based on desired product properties. However, to ensure good mechanical properties and corrosion resistance of the cast product, Zn is limited to 5.30 to 5.9 wt-%, Mg is limited to 2.07 to 3.3 wt-%, Cu is limited to 1.2 to 1.45 wt-%, and Fe is limited to 0 to 0.5 wt-%. According to embodiments, the Zn content may be limited to 5.60 to 5.80 wt-%. According to embodiments, the Mg content may be limited to 2.30 to 2.50 wt-%. According to embodiments, the Cu content may be limited to 1.20 to 1.40 wt-%. Said narrower limits for Zn, Mg and/or Cu may give the cast product better mechanical properties and corrosion resistance while the tendency to form cracks remains low when the casting is carried out according to the present invention. According to the invention, the balance is aluminium. Impurities may be included in the alloy according to the invention up to 0.20 wt-% for each element and up to 0.50 wt-% in total.

When the casting conditions in direct chill casting for such an alloy do not fulfill equation V*D≤0.00057−0.0017*cSi, wherein V is the casting speed (that is the vertical speed of the bottom block) in meter per second, D is the diameter (for example the largest circle equivalent diameter in meter) of the cast product in meter and cSi the silicon content of the alloy in weight percent, cracking occurs resulting in a cast product with poor quality. On the other hand, when the casting conditions do not fulfill equation V*D≥0.00047−0.0017*cSi, then there is no efficient use of the casting equipment and the production rate of the cast product is insufficient.

When the silicon content of the melt, cSi, is higher than 0.1 wt-%, (and consequently also the silicon content of the alloy that forms the cast product after solidification of the melt), the mechanical product properties deteriorate and in addition the alloy/melt requires a casting speed that is too low.

Accordingly, as shown in FIG. 6, the Si content may be chosen based on the desired casting speed to allow efficient use of the casting equipment, or, if the Si content is fixed due to product specification, an optimal casting speed may be chosen. When the process window according to the present invention is used, the casting process can be optimized to cast alloys of the AA7xxx type with the highest possible speed while maintaining product quality.

The invention claimed is:

1. A method for casting comprising a.) determining a diameter (D) of a cross section of a product to be cast in meter (m), b.) determining an intended steady-state casting speed (V) of the product to be cast using direct chill casting in meter per second (m/s), c.) determining a Si content (cSi) in percent by weight based on the total weight of a melt (wt-%) for the melt to be used for casting the cast product, wherein the intended diameter (D), the intended steady-state casting speed (V) and the intended Si content (cSi) are determined such that the equations $$V*D \leq 0.00057-0.0017*cSi \quad \text{(I)}$$

and $$V*D \geq 0.00047-0.0017*cSi \quad \text{(II)}$$

and $$cSi \leq 0.1 \quad \text{(III)}$$

are fulfilled, d.) preparing a melt comprising

Zn: 5.30 to 5.9 wt-%,

Mg: 2.07 to 3.3 wt-%,

Cu: 1.2 to 1.45 wt-%,

Fe: 0 to 0.5 wt-%,

Si: according to cSi, impurities up to 0.2 wt-% each and 0.5 wt-% in total, and balance aluminium, e.) casting the melt into the cast product having the intended diameter (D) using direct chill casting, wherein the casting is carried out using the intended steady-state casting speed (V).

2. The method according to claim 1, wherein two out of the three variables V, D and cSi are determined based on product or process requirements and the third variable is calculated using equations (I) to (III).

3. The method according to claim 1, wherein the casting the melt into the cast product is carried out using between 14 and 20 cubic meter per hour and meter of intended diameter (m3/(h*D)) cooling water for the direct chill casting.

4. The method according to claim 1, wherein in the preparing the melt, between 0.025 and 0.1 wt-% grain refiner based on Al, Ti and/or B are added to the melt.

5. The method according to claim 1, wherein the diameter (D) of the product to be cast is the largest circle equivalent diameter in a cross section of the product to be cast.

6. The method according to claim 1, wherein the diameter (D) of the product to be cast is larger than 450 mm and wherein optionally a wiper is used to remove water from the casted product, and wherein optionally the wiper is arranged such that it is on a vertical level of a bottom of the solidification zone of the product during steady-state casting.

* * * * *